US005078366A

United States Patent [19]

Sicking et al.

[11] Patent Number: 5,078,366

[45] Date of Patent: * Jan. 7, 1992

[54] GUARDRAIL EXTRUDER TERMINAL

[75] Inventors: Dean L. Sicking; Asif Qureshy, both of College Station; Hayes E. Ross, Jr., Bryan; C. Eugene Buth, College Station, all of Tex.

[73] Assignee: Texas A&M University System, College Station, Tex.

[ * ] Notice: The portion of the term of this patent subsequent to May 29, 2007 has been disclaimed.

[21] Appl. No.: 488,718

[22] Filed: Mar. 5, 1990

Related U.S. Application Data

[63] Continuation-in-part of Ser. No. 143,367, Jan. 12, 1988, Pat. No. 4,928,928.

[51] Int. Cl.[5] ..... E01F 15/00

[52] U.S. Cl. ..... 256/13.1; 256/19; 404/6; 188/377

[58] Field of Search ..... 256/13.1, 19, 1; 404/6, 404/9, 10; 403/2, 279, 284; 188/371, 377; 293/133, 110

[56] References Cited

U.S. PATENT DOCUMENTS

| | | | |
|---|---|---|---|
| 2,135,705 | 11/1938 | Florance | 256/13.1 |
| 2,146,445 | 2/1939 | Russert et al. | 256/13.1 |
| 2,776,116 | 1/1957 | Brickman . | |
| 3,450,233 | 6/1969 | Massa . | |
| 3,519,301 | 7/1970 | Somnitz | 188/371 X |
| 3,643,924 | 2/1972 | Fitch | 256/13.1 |
| 3,768,781 | 10/1973 | Walker et al. | 256/13.1 |
| 3,779,591 | 12/1973 | Bands | 293/133 |
| 4,063,713 | 12/1977 | Anolick et al. | 256/13.1 |
| 4,181,198 | 1/1980 | Lindberg | 188/371 |
| 4,274,665 | 6/1981 | Marsh, Jr. | 403/279 |
| 4,330,106 | 5/1982 | Chisum . | |
| 4,389,134 | 6/1983 | Colas | 403/284 |
| 4,399,980 | 8/1983 | Van Schie | 188/377 |
| 4,655,434 | 4/1987 | Bronstad | 403/2 |
| 4,678,166 | 7/1987 | Bronstad et al. | 256/19 |
| 4,815,565 | 3/1989 | Sicking | 256/1 |
| 4,844,213 | 7/1989 | Travis | 256/13.1 X |
| 4,928,928 | 5/1990 | Buth et al. | 256/13.1 |

FOREIGN PATENT DOCUMENTS

| | | |
|---|---|---|
| 0245042 | 11/1987 | European Pat. Off. . |
| 1567601 | 5/1969 | France . |

*Primary Examiner*—Peter M. Cuomo
*Attorney, Agent, or Firm*—Kareem M. Irfan

[57] ABSTRACT

A guardrail extruder terminal for flattening a folded or W-beam guardrail and bending the guardrail to dissipate the energy of a vehicle impacting the end of the guardrail includes a feeder chute. The feeder chute is provided with an inlet in which the guardrail is positioned. The feeder chute extends into a terminal housing, and is in communication with an extruder or flattening throat. The flattening throat is of a smaller width than the feeder chute to-flatten the guardrail. A bending member is also provided in the terminal to bend the guardrail in an curvilinear arc away from the impacting vehicle. Also included is a cable anchor releasably mounted on the guardrail. A cable extends from the cable anchor to a first post located at the end of the guardrail. The cable anchor includes lugs that release from the guardrail upon engagement of the extruder terminal with the cable anchor. To prevent twisting, bending or rotation of posts holding the guardrail as the extruder terminal and impacting vehicle move down the guardrail during a collision, a groundline cable extends through bores in each post. In an alternative embodiment, the extruder throat includes side walls defined by curvilinear extruder plates. The curvilinear extruder plates minimize the engagement of the guardrail with the side walls of the extruder throat during impact by a vehicle to reduce the frictional forces experienced during initiation of the flattening process.

8 Claims, 8 Drawing Sheets

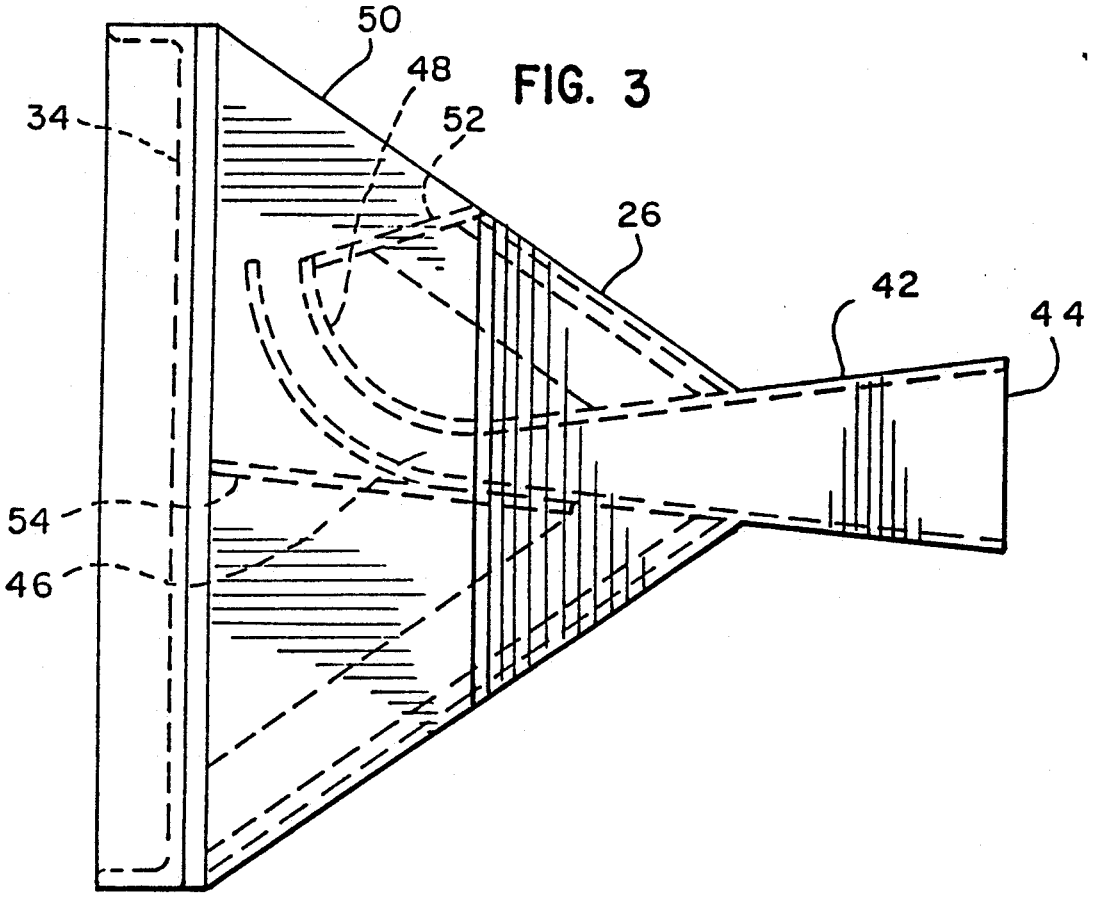
FIG. 3
FIG. 4
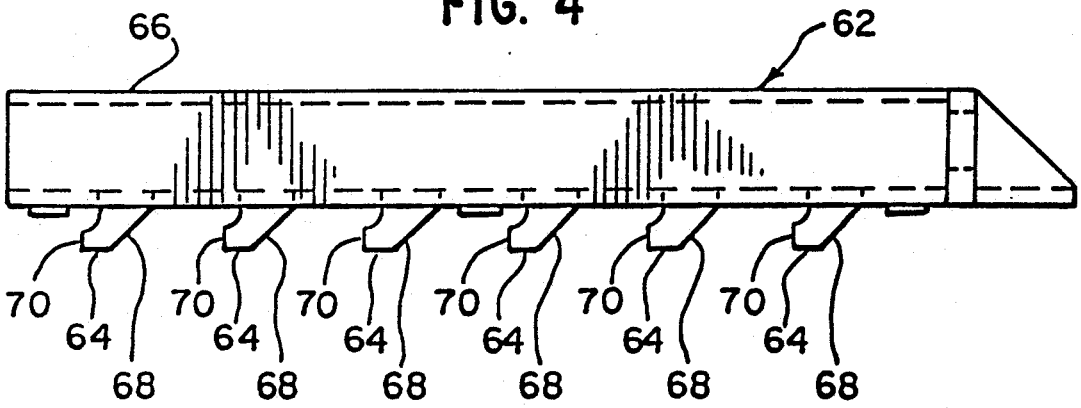

GUARDRAIL EXTRUDER TERMINAL

This application is a continuation in part of application Ser. No. 143,367 filed on Jan. 12, 1988, now U.S. Pat. No. 4,928,928.

A. BACKGROUND OF THE INVENTION

The device of the present invention generally relates to a new and improved safety treatment for the ends of W-beam guardrails; and more particularly, to a new and improved guardrail extruder terminal that is mounted at the end of a W-beam guardrail for dissipating impact energy of a car colliding with the end of the W-beam guardrail in an accident.

B. DESCRIPTION OF THE PRIOR ART

Along most highways there are hazards that can be a substantial danger to drivers of automobiles if the automobiles were to leave the highway. To prevent accidents due to vehicles leaving a highway, guardrails are provided. Guardrails must be installed such that the terminal end of the guardrail facing the flow of traffic is not a hazard. Early guardrails had no proper termination at the ends, and it was not uncommon for impacting vehicles to become impaled on the guardrail causing intense deceleration of the vehicle and severe injury to the occupants. In some reported cases, the guardrail penetrated directly into the occupant compartment of the vehicle fatally maiming the occupants.

Upon recognition of the problem of proper guardrail termination, guardrail designs were developed that used box beams and W-beams that allow tapering of the end of the guardrail into the ground providing a ramp and eliminating any spearing effect. While these end treatments successfully removed the danger of the vehicle being penetrated in a head-on collision, it was discovered that these end treatments could induce launching of the vehicle causing it to become airborne for a considerable distance with the possibility of roll over.

In search for better end treatments, improved end treatments such as break away cable terminals (BCT), vehicle attenuating terminals (VAT), and the Sentre end treatment were developed. These end treatments do not induce the dangerous vaulting and roll over of vehicles. The BCT end treatment is designed to cause a W-beam guardrail to buckle out of the way of an impacting vehicle. Since this design relies on dynamic buckling of the W-beam, it is sensitive to many installation details such as barrier flare rate and end off-set. Consequently, this design has not had a favorable service history.

The VAT safety treatment consists of overlapped guardrail sections that have a series of closely spaced slots. The guardrail segments are attached by bolts extending through the slots. When a vehicle impacts the end of this barrier, the bolts are forced to tear through the W-beam from one slot to the next. As a result, W-beam segments are cut into several long ribbons as an impacting vehicle is decelerated. The VAT safety treatment has no field service record, but it is believed that this system is too costly for wide spread implementation.

The Sentre end treatment is constructed from a series of break away steel guardrail posts and fragile plastic containers. Impacting vehicles are decelerated as the guardrail posts are broken and sand bags in the plastic containers are impacted. A cable is used to guide vehicles away from the guardrail during impact. This system is very expensive, and due to this expense, has not gained wide acceptance.

It would be desirable to develop an end treatment that can be used at virtually any end of a guardrail as a means of attenuating head on impacts as well as for providing anchorage for impacts to the sides of the barrier. It is also desirable that such an end treatment be easily installed and serviced and inexpensive to manufacture.

SUMMARY OF THE INVENTION

An object of the present invention is to provide a new and improved end treatment for highway guardrails.

Another object of the present invention is to provide a new and improved terminal for highway guardrails that is inexpensive and easy to install.

A further object of the present invention is to provide a new and improved guardrail extruder terminal that dissipates impact energy through the straining of W-beam guardrails.

A still further object of the present invention is to provide a new and improved W-beam guardrail end treatment that forces the guardrail through a bending structure which squeezes the guardrail into a relatively flat plate and bends it about a circular arc directed away from the impacting vehicle.

Another object of the present invention is to provide a new and improved end treatment for W-beam guardrail that dissipates impact energy and develops W-beam tensile capacity with a cable anchoring system that releases from the guardrail upon impact with the end treatment.

A still further object of the present invention is to provide a new and improved method for dissipating the impact energy of a vehicle colliding with an end of a guardrail by flattening and bending the guardrail.

Briefly, the present invention is directed to a new and improved device commonly referred to as an end treatment for a W-beam guardrail. The end treatment of the present invention is an extruder terminal that dissipates impact energy through straining of the guardrail. Specifically, the end treatment squeezes a W-beam guardrail into a relatively flat plate and bends the guardrail around an arc directed away from the impacting vehicle.

The extruder terminal includes a feeder chute into which the upstream end of a guardrail is positioned. The feeder chute gradually narrows to a narrow extruder throat. The extruder throat is narrower in width than the feeder chute. This reduction in width flattens a W-beam guardrail as it is forced through the chute and into the throat by impact of the terminal by a vehicle. The extruder terminal also includes a bending section that bends the flattened guardrail in a curvilinear arc in a direction away from the impacting vehicle.

The extruder of the present invention further includes a cable anchor for providing tensile strength in the guardrail necessary for downstream collisions. The cable anchor includes a plurality of lugs each with an inclined surface. Each lug is mounted in an aperture in the guardrail at a location downstream of a first post on which the guardrail is mounted. A cable extends from the cable anchor and is anchored to the first post. The lugs are of a configuration such that upon engagement of the cable anchor by the feeder chute during a collision with a vehicle, the cable anchor releases from the apertures in the guardrail. By releasing from the guardrail, the cable anchor moves out of position with the feeder chute thus avoiding jamming of the extruder terminal.

A problem often encountered in guardrail systems during an end on collision is that the posts to which the guardrail is mounted tend to bend and rotate prior to breaking off. To overcome this bending and rotation problem, a groundline cable is provided. The groundline cable includes a cable extending through bores of a plurality of posts on which the guardrail is mounted. The groundline cable is anchored to one of these posts at first end of the cable, and extends upstream through the remaining posts and is anchored to the post upon which the extruder terminal is mounted. During a collision with the extruder terminal, the groundline cable prevents rotation of the posts while the bore in each post sufficiently weakens the posts allowing them to break off upon engagement with the extruder terminal and impacting vehicle.

The present invention is further directed to an improved guardrail extruder terminal that requires less force to initiate the flattening of a folded guardrail upon impact by a vehicle. A reduction in the force required to initiate flattening is accomplished by reducing the large frictional forces generated by the engagement of the guardrail with the chute of the extruder in the terminal. The frictional forces are reduced by minimizing the surface of the guardrail in engagement with the extruder.

BRIEF DESCRIPTION OF THE DRAWINGS

The above and other objects and advantages and novel features of the present invention will become apparent from the following detailed description of a preferred embodiment of the invention illustrated in the accompanying drawings wherein:

FIG. 3 is a detailed top plan view of the extruder terminal of the present invention;

FIG. 4 is an enlarged side elevation view of a cable anchor constructed in accordance with the principles of the present invention;

DESCRIPTION OF THE PREFERRED EMBODIMENT

Existing guardrail end treatments have proven to be unsafe, sensitive to installation details, or very costly. The present invention is a safety treatment for the ends of a W-beam guardrail which reduces end treatment costs and the number of injuries and deaths associated with guardrail terminal accidents.

Figure 2:
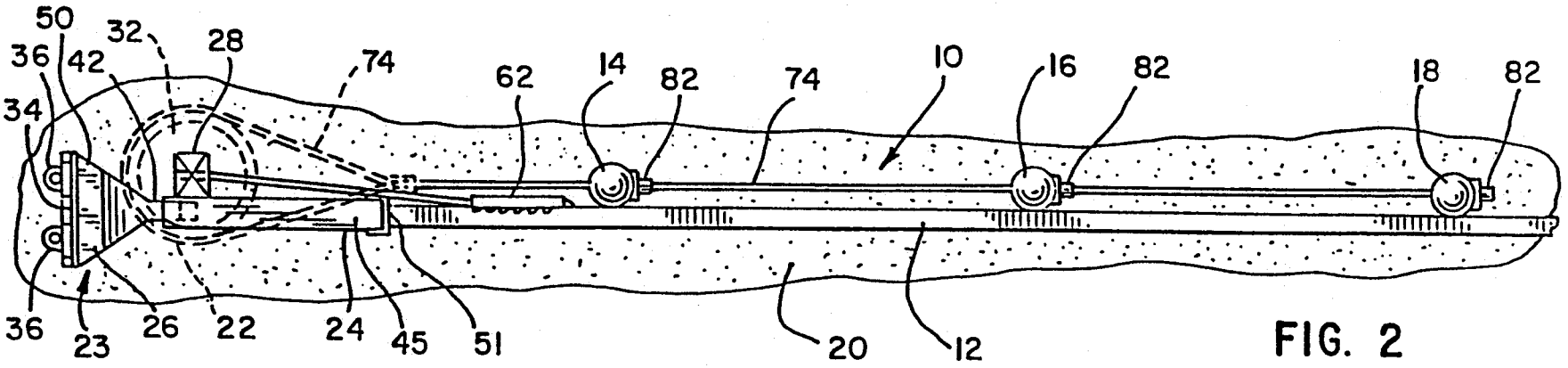
FIG. 2 is a top plan view of the guardrail system illustrated in FIG. 1.
Figure 1:
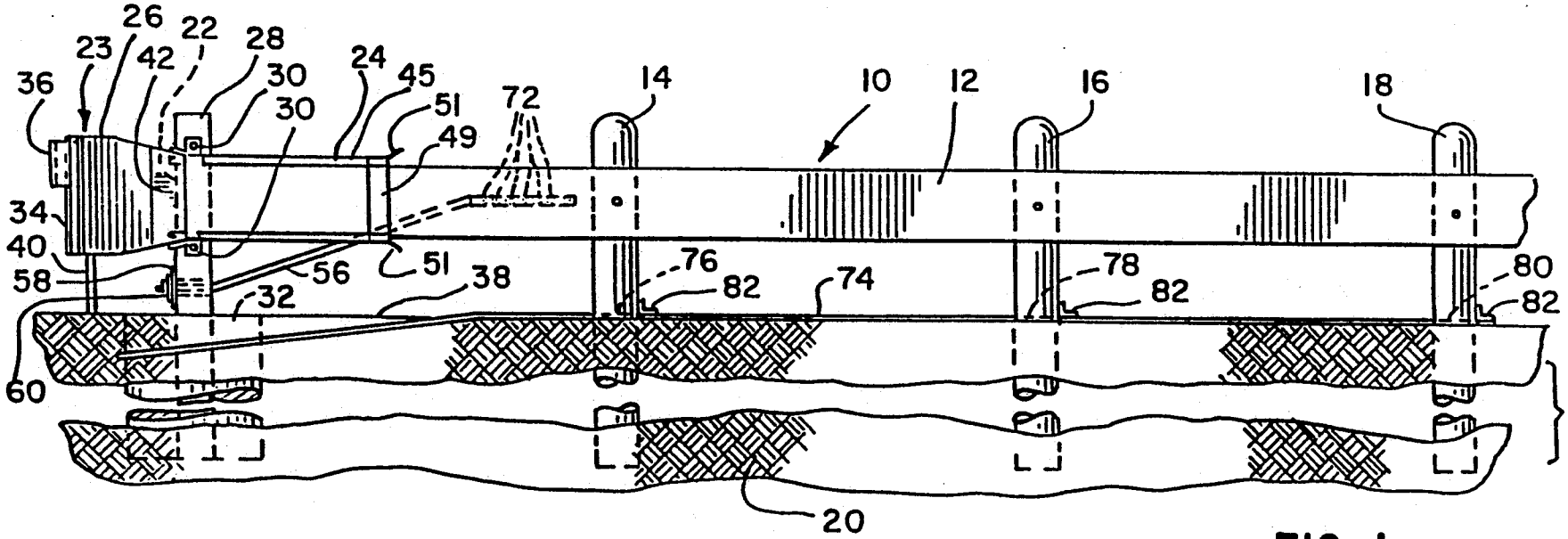
FIG. 1 is a side elevation view of a guardrail system including an extruder terminal constructed in accordance with the principles of the present invention.

A guardrail system including the present invention is generally designated by the referenced numeral 10 and is illustrated in FIGS. 1 and 2. The guardrail system 10 includes a W-beam guardrail 12 mounted on a plurality of 7" round wooden posts 14, 16 and 18. The wooden posts 14, 16 and 18 are imbedded in soil 20. The guardrail 12 and the posts 14, 16 and 18 are typically mounted along a highway to prevent collisions with roadside hazards. It is intended that a vehicle will impact the guardrail 12 downstream of the post 14; however, a collision with the end 22 of the guardrail can occur with life threatening results. To minimize the potential for a life threatening accident with the end 22, an end treatment generally designated by the reference numeral 23 is provided. In a collision with the end 22, a vehicle will hit the end treatment 23. The purpose of the end treatment 23 is to dissipate impact energy of the vehicle without creating a dangerous condition such as causing the vehicle to roll-over or allow the guardrail 12 to spear the vehicle or the occupant compartment of the vehicle.

The end treatment 23 includes a feeder chute 24 and an extruder terminal 26. The extruder terminal 26 is mounted onto a first post 28 by fasteners 30 such as bolts, and the upstream end 22 of the guardrail 12 extends into the feeder chute 24. The first post 28 is a rectangular 6"×8" wooden post embedded in concrete 32 in the soil or ground 20.

The extruder terminal 26 includes a front striking plate 34 and a pair of resilient bumpers 36 are secured to the front striking plate 34 to engage a vehicle upon collision. To ensure that the extruder terminal 26 is at the proper height relative to the groundline or level 38, one or more extruder legs 40 are secured to the bottom of the extruder terminal 26. The extruder legs 40 are intended to engage the groundline 38, and are primarily for support, but they also ensure that an installer accurately positions the extruder terminal 26 relative to the groundline 38.

During a collision, the feeder chute 24 functions as a guide to guide the guardrail 12 into an extruder chute 42 (FIG. 3). The feeder chute 24 is defined by an upper channel 45 and a lower channel 47. The upper channel 45 and lower channel 47 are joined by a pair of stabilizing plates 49. The stabilizing plates 49 provide stabilization necessary for guiding the W-beam guardrail 12 into the inlet 44 of the extruder chute 42 (FIG. 3). Bending of the feeder chute 24 will stop the movement of the extruder terminal 26, and the stabilization plates 49 provide sufficient bending strength to the feeder chute 24 to prevent or minimize bending during a collision.

The feeder chute 24 also keeps the extruder terminal 26 from rotating relative to the W-beam guardrail 12 during an impact or collision. If the extruder terminal 26 were to rotate during impact, the guardrail 12 would no longer feed into the extruder terminal 26 resulting in an immediate deceleration of the impacting vehicle and causing a dangerous condition.

The feeder chute 24 includes guides 51 that prevent shaving of the W-beam guardrail 12 by the ends of the feeder chute 24 as the feeder chute 24 moves down the length of the W-beam guardrail during a collision. The guides 51 accommodate any irregularities or bumps in the W-beam guardrail 12 to ensure proper feeding of the guardrail 12 into the extruder terminal 26.

The extruder chute 42 includes an inlet 44 that, in a preferred embodiment, is 4" wide. This compares with the width of a typical W-beam guardrail which is about 3.25" wide. The extruder chute 42 is funnel shaped and narrows down to an extruder throat 46 (FIG. 3). The extruder throat is 1" wide. As the W-beam guardrail 12 moves down the extruder chute 42 and into the extruder throat 46, it is flattened from 3" wide to 1" wide. As this flattening process occurs, substantial energy is dissipated slowing the impacting vehicle.

Once the W-beam guardrail 12 is flattened, the bending strength of the guardrail 12 is eliminated or substantially reduced. As the extruder terminal 26 moves further down the W-beam guardrail 12, flattened the W-beam guardrail 12 is forced through a curvilinear bending chute or member 48 (FIG. 3). The bending chute 48 must be relatively rigid to bend the flattened guardrail 12. To accomplish the desired rigidity, the bending chute 48 is secured to the housing of the extruder terminal 26 by a support 52. As the flattened W-beam guardrail 12 moves along the bending chute 48, it is bent in a curvilinear arc in a direction away from the impacting vehicle and exits the extruder terminal 26 through an outlet 50.

The radius of the bending chute 48 can be selected to bend the W-beam guardrail 12 in a circular arc, an elliptical arc, a spiral or any other configuration desired. It has been determined that different arcs result in different rates of dissipation of energy. As a result, the energy dissipation rate can be varied by the selection of the radius of the bending chute 48.

A support plate 54 mechanically supports the front striking plate 34 and prevents it from contacting the bending chute 48. Contact between the bending chute 48 and the striking plate 34 could bring the extrusion process to a stop.

Following the initial impact of a vehicle with the extruder terminal 26 and the initiation of the flattening and bending of the W-beam guardrail 12, the impacting vehicle and extruder terminal 26 engage the first post 28 breaking it at the groundline 38. As this occurs, a cable 56 anchored at a first end to the first post 28 by plates 58 and nut 60 is released. The cable 56 is a break away cable of the type used to provide tensile strength to the W-beam guardrail 12. The opposite or second end of the cable 56 is connected to an cable anchor 62. The cable anchor 62 includes a plurality of lugs 64 (FIG. 4) and a steel tube 66 on which the lugs 64 are welded. The lugs 64 are wedge shaped and include an inclined surface 68 and a lip 70. The lugs 64 protrude into apertures 72 formed in the W-beam guardrail 12 between the first post 28 and the second post 14.

Prior to impact with a vehicle, cable 56 is taunt and the lips 70 of the lugs 64 hook onto the sides of the apertures 72 securely holding the anchor 62 onto the W-beam guardrail 12. During a collision as the impacting vehicle breaks the first or lead post 28, the cable 56 is released at the first end. As the feeder chute 24 moves down the W-beam guardrail 12 during the collision, it engages the anchor 62. Since the tension has been released in cable 56, engagement of the feeder chute 24 with the anchor 62 causes the included surfaces 68 to engage the sides of the apertures 72. This engagement moves the lugs 64 out of the apertures 72 releasing the anchor 62 from the W-beam guardrail 12. The release of the anchor 62 moves it out of the way of the extruder terminal 26 thereby avoiding possible jamming of the movement of the terminal 26.

As the extruder terminal 26 continues moving down the W-beam guardrail 12 under the impacting force of the vehicle, the extruder terminal 26 and impacting vehicle engage the first wooden post 14. Upon impact, the first wooden post 14 is broken off at the groundline 38. Similarly, until the entire impact energy of the colliding vehicle is dissipated, the extruder terminal 26 moves downstream along the W-beam guardrail 12 snapping off the posts 16 and 18 at the groundline 38.

During the collision and movement of the extruder terminal 26 down the length of the W-beam guardrail 12, posts 14, 16 and 18 tend to bend or rotate. To prevent this bending or rotation of the posts 14, 16 and 18, past attempts have been to embed the posts 14, 16 and 18 in concrete. This procedure is extremely expensive. In accordance with the principles of the present invention, bending or rotating of the posts 14, 16 and 18 is eliminated using a groundline cable 74.

A first end of the groundline cable 74 is looped around and anchored to the concrete 32 in which the first or lead post 28 is embedded. The groundline cable 74 is anchored at a location below the groundline 38 to prevent release of the groundline cable 74 from its anchorage upon impact of the vehicle with the first post 28. The groundline cable 74 extends through a bore 76 in post 14, a bore 78 in post 16, and a bore 80 in post 18. The bores 76, 78 and 80 serve two functions. The first function is to allow a transverse mechanical connection between the groundline cable 74 and the posts 14, 16 and 18. Secondly, the bores 76, 78 and 80 weaken the posts 14, 16 and 18, respectively, at the groundline 38 ensuring that they will snap off upon collision even when hit by a light weight vehicle.

Each post 14, 16 and 18 is secured to the groundline cable 74 by a backup plate and cable clamps 82. By being mechanically fixed to the groundline cable 74, the posts 14, 16 and 18 will not rotate or twist upon collision with a vehicle, but will snap or break off at the groundline 38 upon impact with the vehicle. This solution to the rotating or twisting problem is inexpensive, and is easy to install.

Extruder terminal 26 has been described as first flattening the W-beam guardrail 12 and then bending it in a curvilinear arc away from the direction of travel of the impacting vehicle. It should be understood, however, that the extruder terminal 26 can be designed to bend the W-beam guardrail 12 without first flattening it. This can be accomplished by the elimination of the extruder throat 46, and designing the extruder chute 42 without a reduction in width so that flattening does not occur. With these changes, the unflattened W-beam guardrail 12 is fed directly into the bending chute 48.

Existing guardrail end treatments have proven to be unsafe, sensitive to installation details, and costly. The extruder terminal 26 of the present invention meets national safety requirements, and is inexpensive compared to other available end treatments since the extruder terminal 2 has few parts and is not sensitive to installation details. The extruder terminal 26 has the additional advantage that it does not require the end of the guardrail 12 to be flared away from the traveled way, and it can be used at virtually any roadside location.

It has been determined that there is a high force required to initiate the flatting process of a W-type or folded guardrail as it passes through the extruder chute 42 of the end treatment 23. A folded guardrail may have one or several folds. For example, a double folded guardrail is a W-type guardrail. For the purposes of this invention, it should be understood that any folded guardrail may be used.

Figure 5:
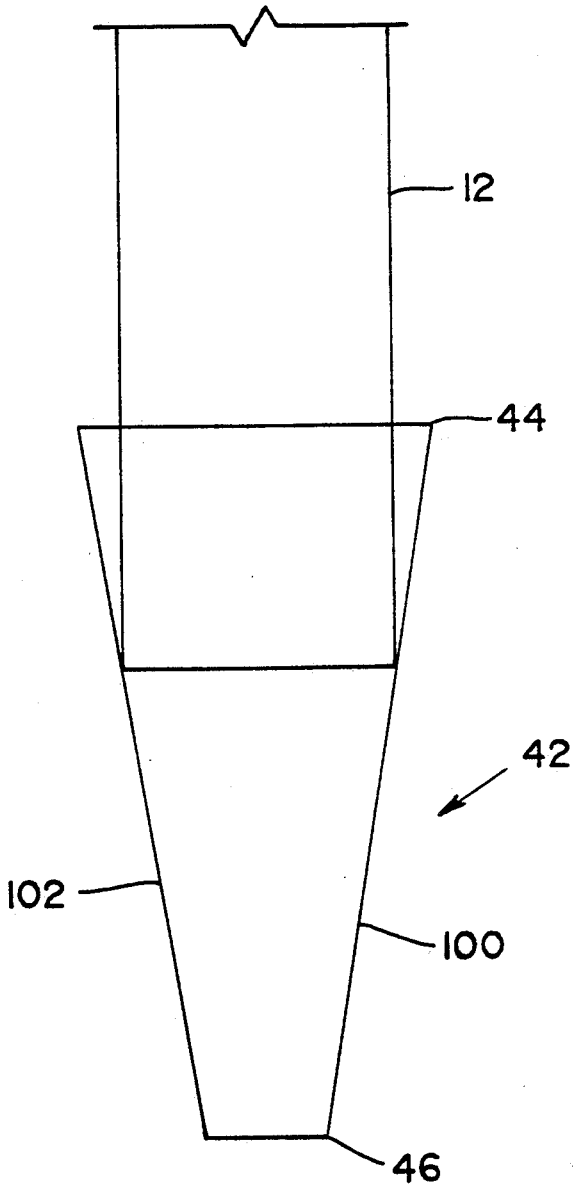
FIG. 5 is a cross sectional illustration of the extruder chute illustrated in FIG. 3 with a guardrail positioned in the extruder chute prior to impact by a vehicle.

The higher initiation force was discovered to be the result of large frictional forces experienced during the flatting process. To understand these frictional forces, reference is made to FIGS. 5-7. FIG. 5 illustrates a schematic cross sectional view of the extruder chute 42. The extruder chute 42 extends between an inlet 44 and the beginning of an extruder throat 46. The sides of the extruder chute 42 are defined by a first flat, planar extruder plate 100 and a second flat, planar extruder plate 102. During the early stages of impact of the end treatment by a vehicle, the W-type or similar folded guardrail 12 is deformed locally until two to three inches of the guardrail 12 are bearing against the flat extruder plates 100 and 102.

Figure 6:
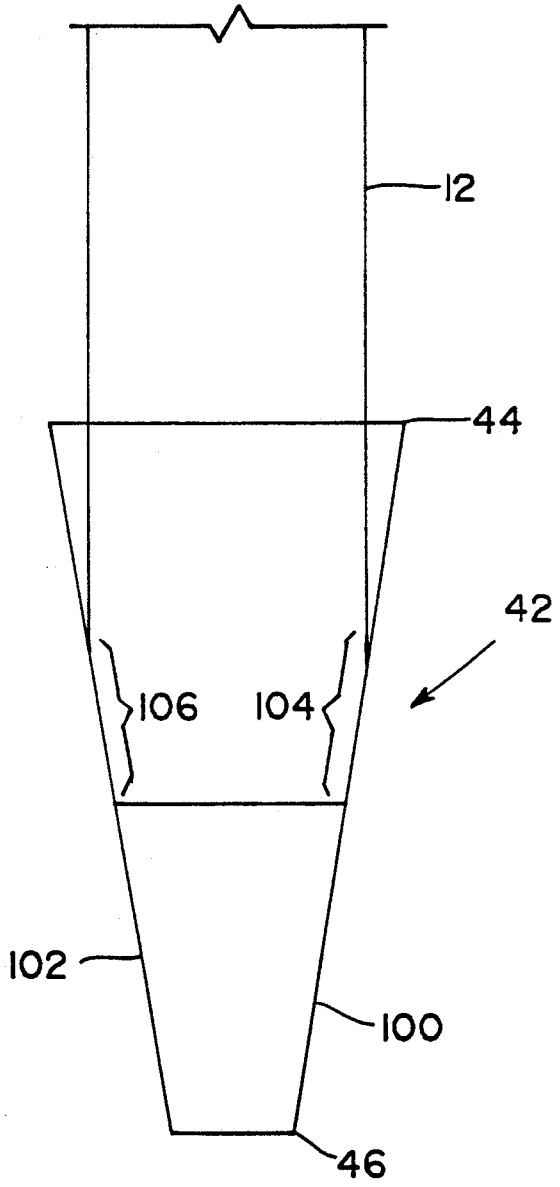
FIG. 6 is a view similar to FIG. 5 but at an early stage of impact by a vehicle.
Figure 7:
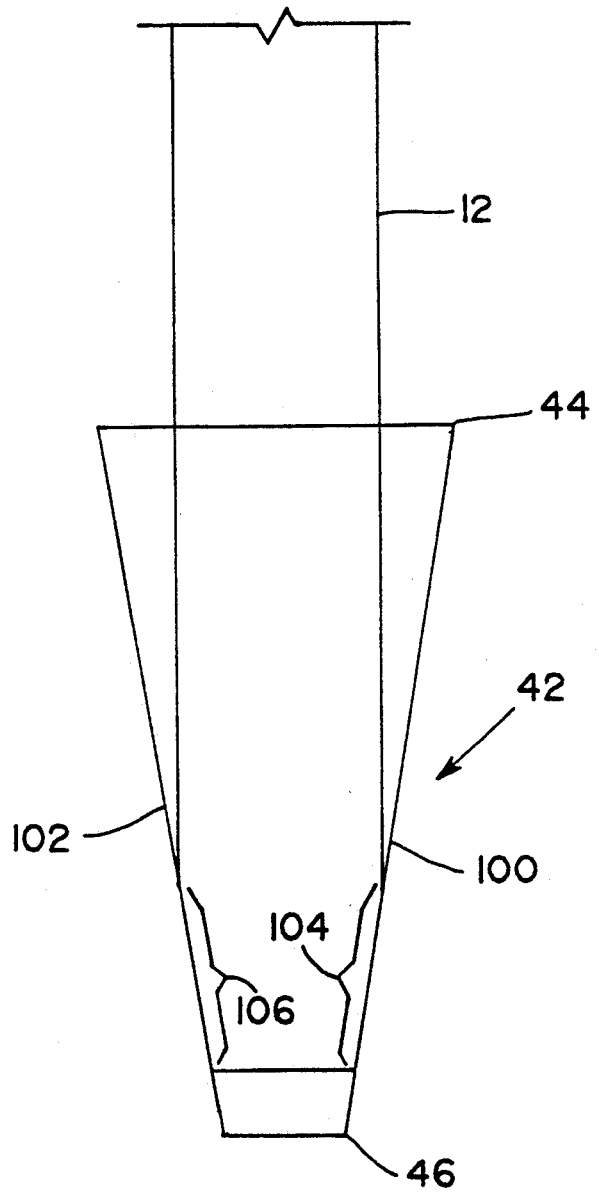
FIG. 7 is a view similar to FIGS. 5 and 6 but at the stage during impact where the guardrail approaches the end of the extruder chute.

This initial deformation is illustrated in FIG. 6. During this initial deformation, the areas 104 and 106 of the guardrail 12 are deformed by and bear against the flat extruder plates 100 and 102. As the end treatment is forced farther down the guardrail 12 by the impacting vehicle, the guardrail 12 continues to be flattened by the extruder plates 100 and 102, but due to the flat planar configuration of the extruder plates 100 and 102, the increasing length of the deformed areas of 104 and 106 continues to bear against the extruder plates 100 and 102 thereby generating a large frictional force (FIG. 7).

Figure 8:
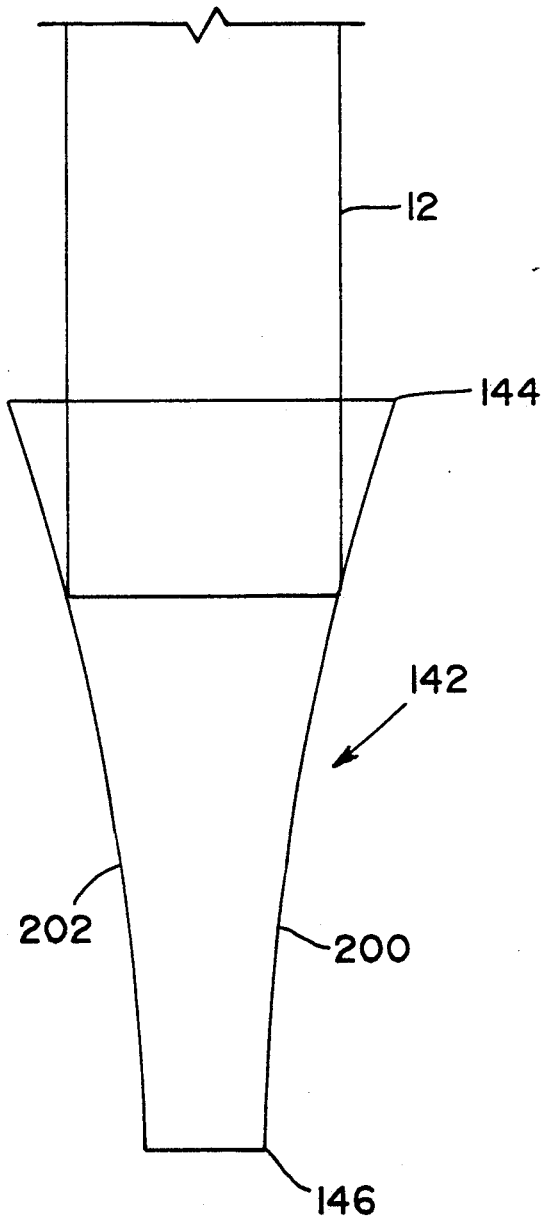
FIG. 8 is a cross sectional illustration of a modified extruder chute with a guardrail positioned in the extruder chute prior to impact by a vehicle.
Figure 9:
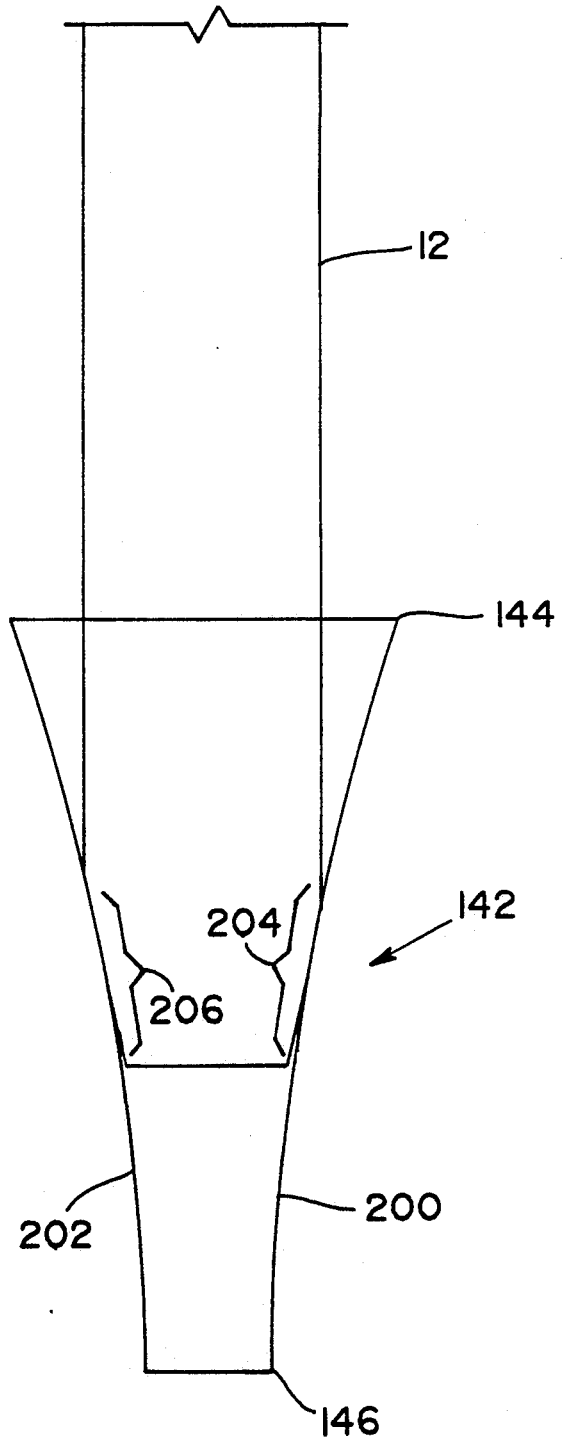
FIG. 9 is a view similar to FIG. 8 but at an early stage of impact by a vehicle.
Figure 10:
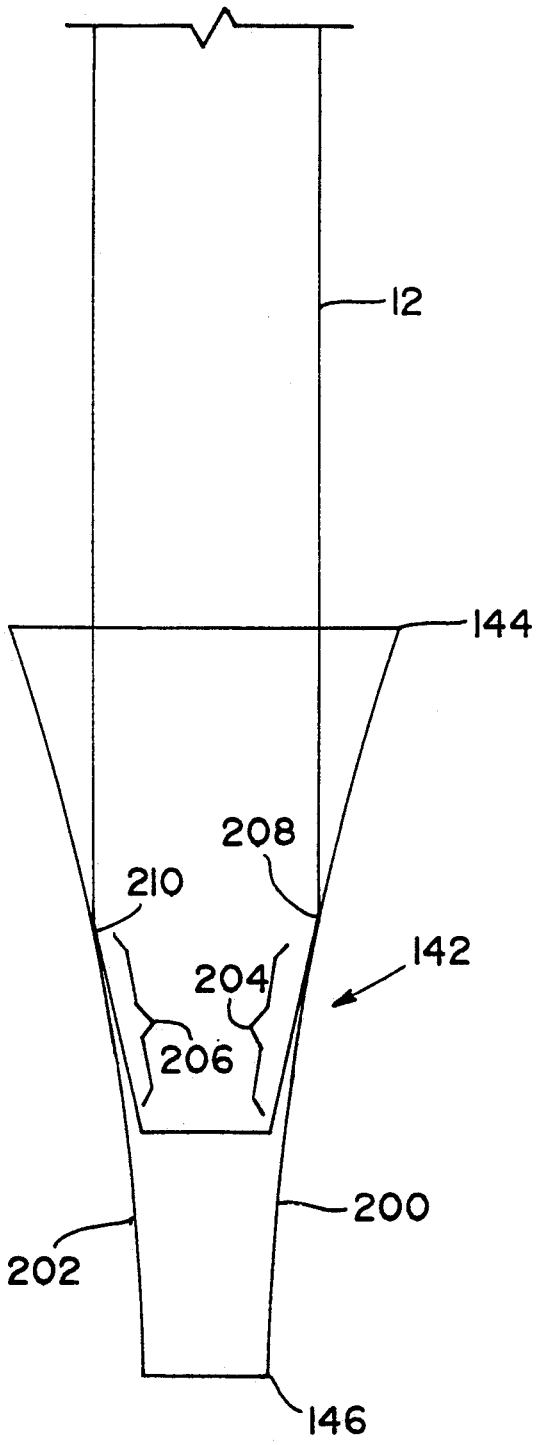
FIG. 10 is a view similar to FIGS. 8 and 9 at the point during impact where the leading end of the guardrail approaches the end of the extruder chute.

If the large friction force can be reduced, the initial extrusion forces can also be substantially reduced. It has been determined that by modifying the extruder chute 42, the friction associated with initiation of the extrusion or flattening process can be reduced by approximately 20%. The extruder chute 142 illustrated in FIGS. 8-10 is a modification of the extruder chute 42 and both chutes 42 and 142 can be used interchangeably in the end treatment. The modified extrusion chute 142 extends between an inlet 144 to the chute and an inlet 146 to an extruder throat. The sides of the modified extruder chute 142 are defined by a first curvilinear extruder plate 200 and a second curvilinear extruder plate 202. Due to the curvilinear configuration of the first extruder plate 200 and the second extruder plate 202, the angle between the first extruder plate 200 and the second extruder 202 at the inlet 144 is larger than the angle between the extruder plate 200 and the extruder plate 202 at the inlet 146 of the extruder throat.

Prior to impact by a vehicle, a W-type or folded beam type guardrail 12 is positioned in the inlet 144 of the extruder chute 142. Upon impact of the end treatment by a vehicle, the end treatment is driven down the guardrail 12, and the guardrail 12 is initially deformed locally as illustrated in FIG. 9. Specifically, the guardrail 12 is flattened or deformed in the areas depicted by reference numerals 204 and 206. The deformed areas or portions 204 and 206 of the guardrail 12 are extruded or flattened to match the slope of the extruder plates 200 and 202 at the point of initial contact. The guardrail 12 is permanently deformed to this initial angle.

Since the angle between the extruder plates 200 and 202 is reduced as the guardrail 12 travels through the extruder chute 142, much of the deformed areas 204 and 206 of the guardrail 12 are out of contact with the converging extruder plates 200 and 202 (FIG. 10) and there are essentially only point or edge contacts 208 and 210 between the guardrail 12 and the extruder plates 200 and 202. Consequently, the frictional force between the guardrail 12 and the extruder plates 200 and 202 is significantly reduced during much of the initiation of the extrusion process. The reduction of the force required to initiate the flattening process of the guardrail 12 due to the curvilinear extruder plates 200 and 202 significantly improves the functional operation of the end treatment 23 and reduces the likelihood that the end treatment 23 will not properly operate or that it will fail during impact by a vehicle.

What is sought and claimed to be secured by Letters Patent of the United States is:

1. A highway guardrail system including a folded beam type guardrail mounted on a plurality of posts, comprising:
   - an extruder terminal mounted on an end of said guardrail for engaging an impacting vehicle;
   - said extruder terminal including an extruder chute; said extruder chute extending between an inlet and an outlet of said extruder terminal
   - said end of said guardrail configured to be positioned in said inlet of said extruder chute; and
   - said extruder chute including first and second opposing curvilinear extruder plates which define a radially converging structure and are positioned to engage and flatten said guardrail upon impact of a vehicle with said extruder terminal.

2. The highway guardrail system set forth in claim 1 wherein said opposing curvilinear extruder plates are curved inwardly toward one another so as to define said radially converging structure and said guardrail is flattened with reduced contact area between said beam and said plates.

3. The highway guardrail system set forth in claim 1, wherein said inlet of said extruder chute is wider than outlet of said extruder chute.

4. The highway guardrail system set forth in claim 1, wherein said opposing curvilinear extruder plates are curved inwardly toward one another to define a throat of decreasing width wherein said inlet of said extruder throat is wider than said outlet of said extruder throat.

5. The highway guardrail system set forth in claim 1, wherein the angle between said first and second opposing curvilinear extruder plates at the inlet of said extruder chute is larger than the angle between said first and second opposing curvilinear extruder plates at the outlet of said extruder chute.

6. A highway guardrail system including a folded beam type guardrail with at least one fold mounted on a plurality of posts, comprising:
   - an extruder terminal mounted on an end of said guardrail;
   - said extruder terminal including an inlet and an outlet and an extruder chute extending between said inlet and said outlet;
   - said end of said guardrail being positioned within said inlet of said extruder chute;
   - said extruder chute including opposed curvilinear extruder plates defining a radially converging structure and including a first angle between said extruder plates at the inlet of said extruder terminal and a second angle at the outlet of said extruder terminal wherein said first angle is larger than said second angle said extruder plates being positioned to engage and flatten said guardrail upon impact of a vehicle with said extruder terminal.

7. The highway guardrail system claimed in claim 6, wherein said extruder plates are curved inwardly to narrow said extruder chute so as to define said radially converging structure and said guardrail is flattened with reduced contact area between said beam and said plates.

8. The highway guardrail system claimed in claim 6, wherein said inlet of said extruder terminal is larger than said outlet of said extruder terminal.

* * * * *